US005989075A

United States Patent [19]

Hsiao et al.

[11] Patent Number: 5,989,075

[45] Date of Patent: Nov. 23, 1999

[54] CONTACT FOR ELECTRICAL CONNECTOR

[75] Inventors: Yu-San Hsiao; Li-Ming Po, both of Tu-Chen, Taiwan

[73] Assignee: Hon Hai Precision Ind. Co., Ltd., Taipei Hsien, Taiwan

[21] Appl. No.: 08/902,771

[22] Filed: Jul. 30, 1997

[30] Foreign Application Priority Data

Aug. 28, 1996 [TW] Taiwan ..... 85213326

[51] Int. Cl.[6] ..... H01R 13/40

[52] U.S. Cl. ..... 439/733.1; 439/444; 439/869

[58] Field of Search ..... 439/444, 869, 439/733.1, 55, 78

[56] References Cited

U.S. PATENT DOCUMENTS 5,460,549 10/1995 Muzslay ..... 439/733.1

5,688,149 11/1997 Aihara ..... 439/733.1

5,800,213 9/1998 Regnier et al. ..... 439/733.1

*Primary Examiner*—Khiem Nguyen

[57] ABSTRACT

A contact for an electric connector is configured as an elongated post. The contact consists of a body portion, a terminal portion for being soldered to a substrate, a PCB for example, a contact portion for engaging with a corresponding contact in a mating connector, a first fitting portion protruding from two lateral sides of the body portion, and a second fitting portion also protruding from the two lateral sides of the body portion. The second fitting portion is located nearer to the terminal portion than the first fitting portion and has a width larger than that of the first fitting portion. When the contact is inserted into a corresponding contact passage defined by a dielectric housing of the connector, the first and second fitting portions will sequentially have an interference fit with the housing.

4 Claims, 6 Drawing Sheets

CONTACT FOR ELECTRICAL CONNECTOR

BACKGROUND OF THE INVENTION

1. Field of the Invention

The invention relates to a contact for an electrical connector, particularly to an improved contact which needs a lower insertion force to be inserted into a connector housing, and can have a better effectiveness of self-alignment so that it can be aligned with a corresponding contact passage when the contact is finally mounted in the connector housing.

2. The Prior Art

As shown in FIG. 1, a perspective view of a conventional contact 10 for an electrical connector (not shown) can be seen. The contact 10 is configured as an elongated post having a generally rectangular cross-section. The contact 10 consists of a body portion 11 which will have an interference fit with a dielectric housing (not shown) of the connector, and be mounted in the dielectric housing. A contact portion 13 is used to engage with a corresponding contact (not shown) in a mating connector (not shown) to achieve an electrical connection. And a terminal portion 12 is to be soldered to a substrate, such as a printed circuit board (PCB).

The prior art contact 10 as shown in FIG. 1 has four sides which are all smooth in nature. The contact 10 would be fixed to the dielectric housing depending on an interference fit of its four sides with the connector housing. Such a feature causes the contact 10 to need a very high insertion force to be inserted into a corresponding contact passage defined by the dielectric housing. A high insertion force easily causes a rupture of the electric housing defining the corresponding contact passage.

Furthermore, due to the high insertion force, the prior art contact 10 needs a large pressing device for inserting the contact 10. A device with a large size means that the device would occupy a large area and needs more material (therefore, higher cost) to construct it.

Finally, since all of the four sides of the contact 10 have an interference fit with the dielectric housing from the point that the contact 10 is inserted into the dielectric housing, if the contact 10 is not aligned properly when inserted into a corresponding contact passage defined by the housing, the misalignment cannot be corrected. In other words, if the contact 10 is initially not aligned properly when inserted into the corresponding contact passage, the contact 10 will also be misaligned when extended through the corresponding contact passage. Because of this, the contact cannot correctly reach its final mounting position and would affect the quality and reliability of the connector.

To overcome the disadvantages of the prior art contact 10, as shown in FIG. 2, another prior art contact 20 is proposed. Like the contact 10, the prior art connector 20 is also configured as an elongated post which consists of a body portion 21, a terminal portion 22 and a contact portion 23. However, in addition to these portions, the contact 20 further has a fitting portion 24 in the form of two projections 25 protruding from two lateral sides of the body portion 21, respectively. In the second prior art contact 20, only the projections 24 will have an interference fit with the connector housing defining the corresponding contact passage into which the contact 20 is going to be inserted. Thus, the insertion force needed for inserting the contact 20 into the housing can be reduced in comparison with the first contact 10. Furthermore, in the second prior art contact 20, the initial misalignment of the contact with the corresponding contact passage can be corrected by the fitting portion 24 when it is engaged with the dielectric housing.

Although, in comparison with the first prior art contact 10, the second prior art contact 20 needs a lower insertion force (therefore a smaller pressing device) to insert the contact 20, the insertion force needed therefor is still deemed quite high.

FIG. 3 is a diagram showing the relation between the insertion force (X-coordinate) and the distance (Y-coordinate) that the fitting portion 24 of the contact 20 is inserted into the corresponding contact passage. From FIG. 3, it can be seen that the maximum insertion force 4250 g (as indicated by arrow P) needed for inserting the contact 20 occurs when the fitting portion 24 is inserted into the corresponding contact passage about 0.1 millimeter. Thereafter, the force is lowered to 2750 g and kept thereon until the contact 20 reaches its final predetermined mounting position.

Furthermore, although the contact 20 can have a self-aligning ability, such an ability is not good enough since it can only be performed once (i.e., when the fitting portion 24 is engaged with the dielectric housing).

Accordingly, although the above mentioned contact 20 is proven to be better than the first mentioned contact 10, the insertion force needed is still deemed quite high and the self-aligning ability achievable thereby is not totally satisfactory. Thus, the contact 20 still needs to be further improved.

Therefore, an objective of the invention is to provide a conductive contact for an electric connector which needs a quite law insertion force to be inserted into a dielectric housing so as to substantially reduce the risk of rupturing the housing.

Another objective of the invention is to provide a conductive contact for a connector which needs a relatively low insertion force to be inserted into a dielectric housing so that the size of the pressing device for generating the insertion force can be quite small. This way, the area the pressing device would occupy and the cost for constructing the pressing device can be considerably reduced.

Still another objective of the invention is to provide a conductive contact for an electric connector, wherein the misalignment of the contact with a corresponding contact passage can be corrected twice by the connector itself when a first and second fitting portion of the contact are sequentially inserted into the dielectric housing.

SUMMARY OF THE INVENTION

According to an aspect of the invention, a contact is configured as an elongated post having a contact portion, a terminal portion opposite the contact portion which is soldered to a PCB and a body portion between the contact and terminal portions. A first fitting portion is projected from two lateral sides of the body portion and a second fitting portion is also projected from the two lateral sides of the body portion, wherein the second fitting portion has a width larger than that of the first fitting portion and is located nearer to the terminal portion than the first fitting portion.

DETAILED DESCRIPTION OF THE PREFERRED EMBODIMENT

References will now be described in detail to the preferred embodiment of the invention. While the present invention has been described in reference to the specific embodiment, the description is illustrative of the invention and is not to be construed as limiting the invention. Various modifications to the present invention can be made to the preferred embodiment by those skilled in the art without departing from the true spirit and scope of the invention as defined by appended claims.

Figure 4:
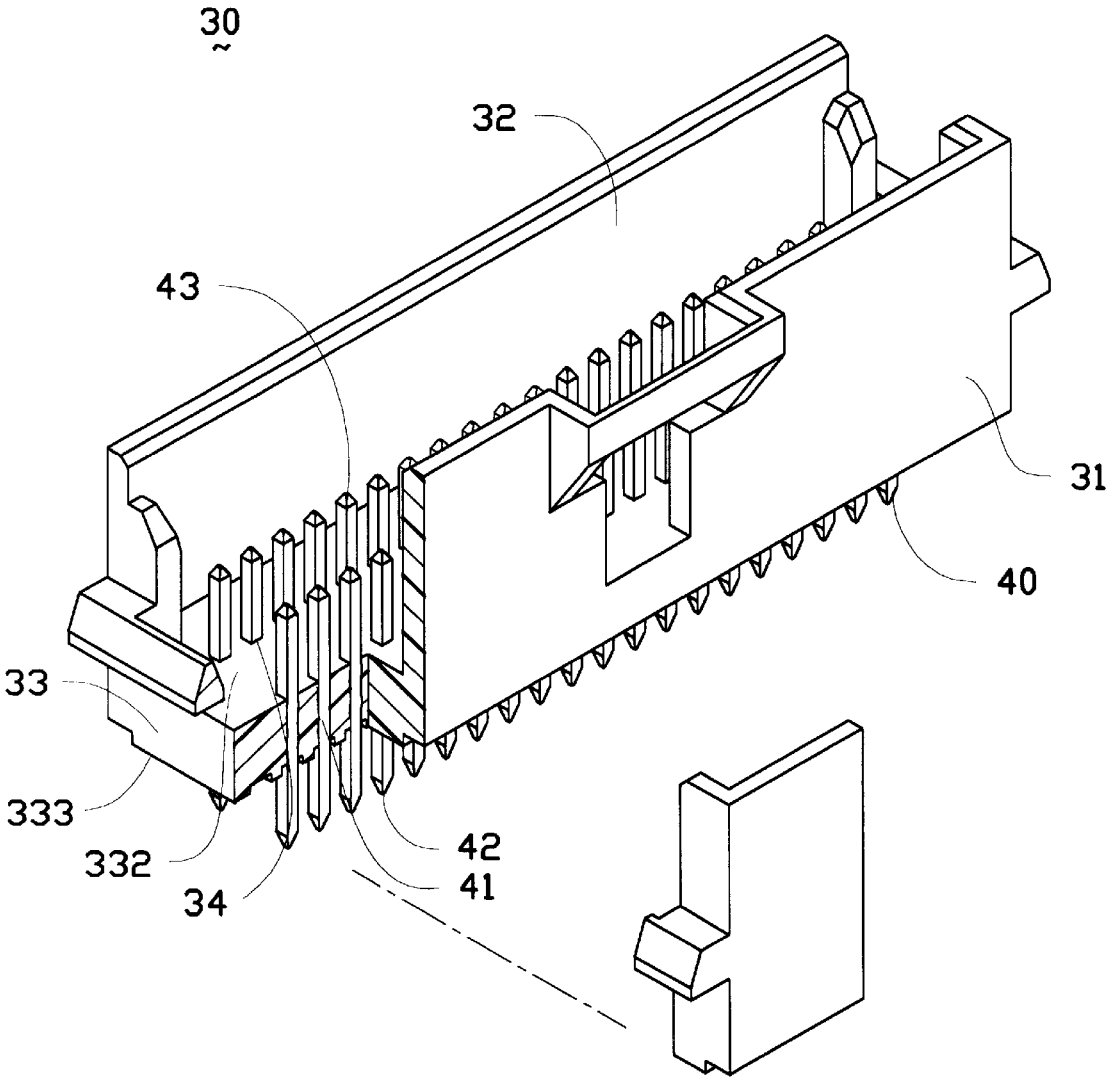
FIG. 4 is a partially cut-away perspective view showing the situation that contacts in accordance with the present invention are mounted in a dielectric housing of an electric connector.
Figure 5:
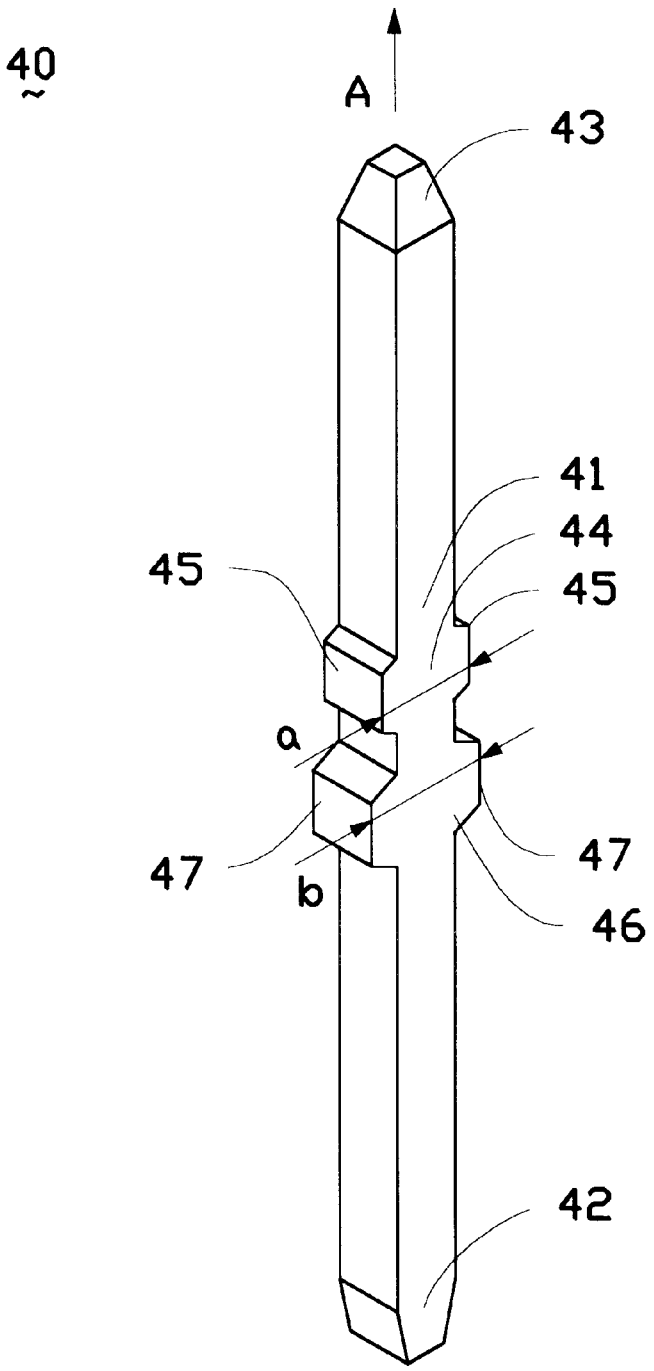
FIG. 5 is a perspective view showing one of the contacts of FIG. 4.

FIGS. 4 and 5 respectively show a number of contacts 40 that are mounted in a dielectric housing 31 of a connector 30 and the details of one of the contacts 40 in accordance with the present invention. The dielectric housing 31, which has an elongated configuration, defines a mating connector receiving chamber 32 for accommodating a mating connector (not shown). A base plate 33 is formed on a lower portion of the housing 31. The base plate 33 has a top face 332 defining a lower face of the mating connector receiving chamber 32, a bottom face 333 and a number of contact passages 34 for a corresponding number of the contacts 40 to extend therethrough.

Each of the contacts 40 is constructed as an elongated post defining a terminal portion 42 used to be soldered to a substrate, for example, a PCB, an opposite contact portion 43 for engaging with a corresponding contact (not shown) in the mating connector to form an electric connection and a body portion 41 between the terminal and contact portions 42, 43. A first fitting portion 44 consisting of two first projections 45 protrudes from two lateral sides of the body portion 41, and a second fitting portion 46 consisting of two second projections 47 also protrudes from the two lateral sides of the body portion 41. The second fitting portion 46 defines a width "b" which is larger than a width "a" defined by the first fitting portion 44, and is located nearer to the terminal portion 42 than the first fitting portion 44.

To mount the contact 40 in the dielectric housing 31, the contact 40 is brought to be inserted into the base plate 33 by extending the contact portion 43 in a direction as indicated by arrow "A" in FIG. 5 from the bottom face 333 of the base plate 33 into a corresponding contact passage 34, whereby the first fitting portion 44 of the contact 40 will initially have an interference fit with the base plate 33 defining the corresponding contact passage 34.

Since the width "a" of the first fitting portion 44 is smaller than the width "b" of the second fitting portion 46, the insertion force needed to insert the first fitting portion 44 is lower than that for inserting the fitting portion 24 of the prior art contact 20, which has a width the same as the width "b" of the second fitting portion 46. The maximum force needed for inserting the first fitting portion 44 into the corresponding contact passage 34 is about 1100 g (as indicated by Q in FIG. 6) when the first fitting portion 44 is inserted into the corresponding contact passage 34 about 0.1 mm.

Thereafter, the insertion force needed is lowered to about 750 g and kept thereon until the second fitting portion 46 is inserted into the contact passage 34. Since in the present invention when the second fitting portion 46 is inserted into the contact passage 34, the contact passage 34 has already been expanded to a certain degree by the first fitting portion 44 and the contact 40 is moving, the insertion force needed for inserting the second fitting portion 46 into the contact passage 34 only needs to be increased from 750 g to about 850 g (as indicated by R in FIG. 6). Thereafter, the insertion force is lowered to 800 g and kept thereon until the contact 40 has reached its final predetermined mounting position as shown by FIG. 4.

Figure 1:
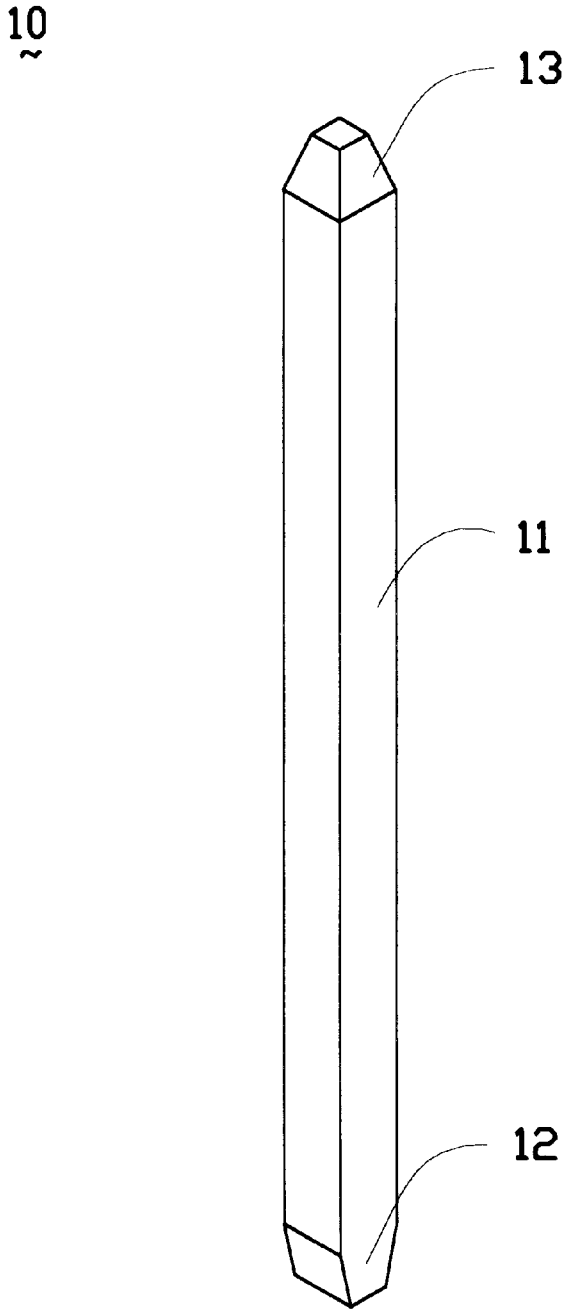
FIG.1 (PRIOR ART)
FIG. 1 is a perspective view showing a prior art conductive contact for an electric connector.
Figure 2:
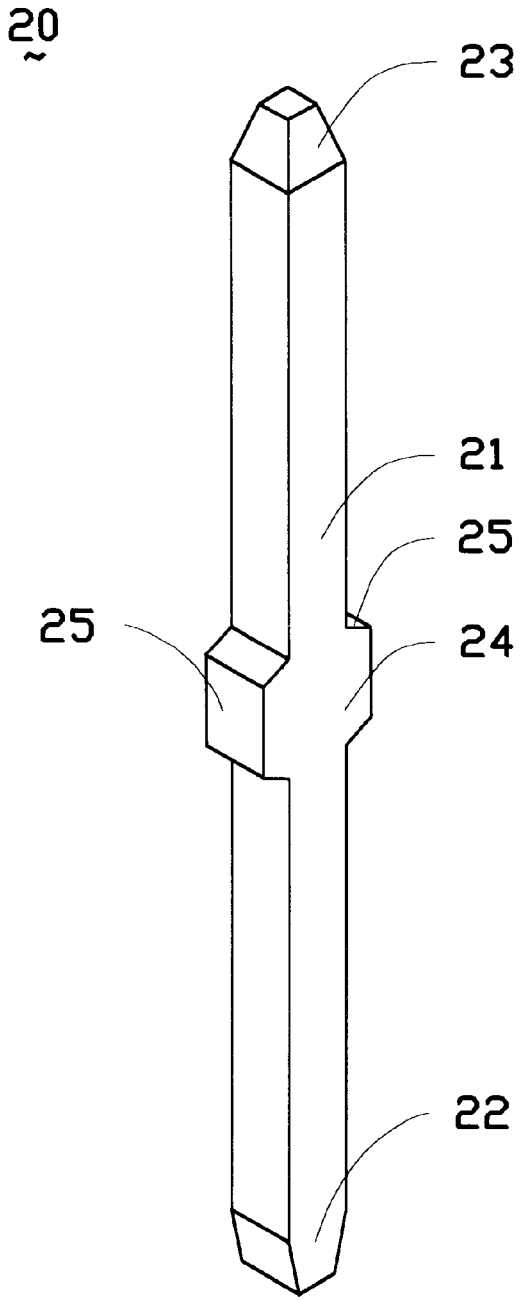
FIG.2 (PRIOR ART)
FIG. 2 is a perspective view showing another prior art conductive contact for an electric connector.
Figure 3:
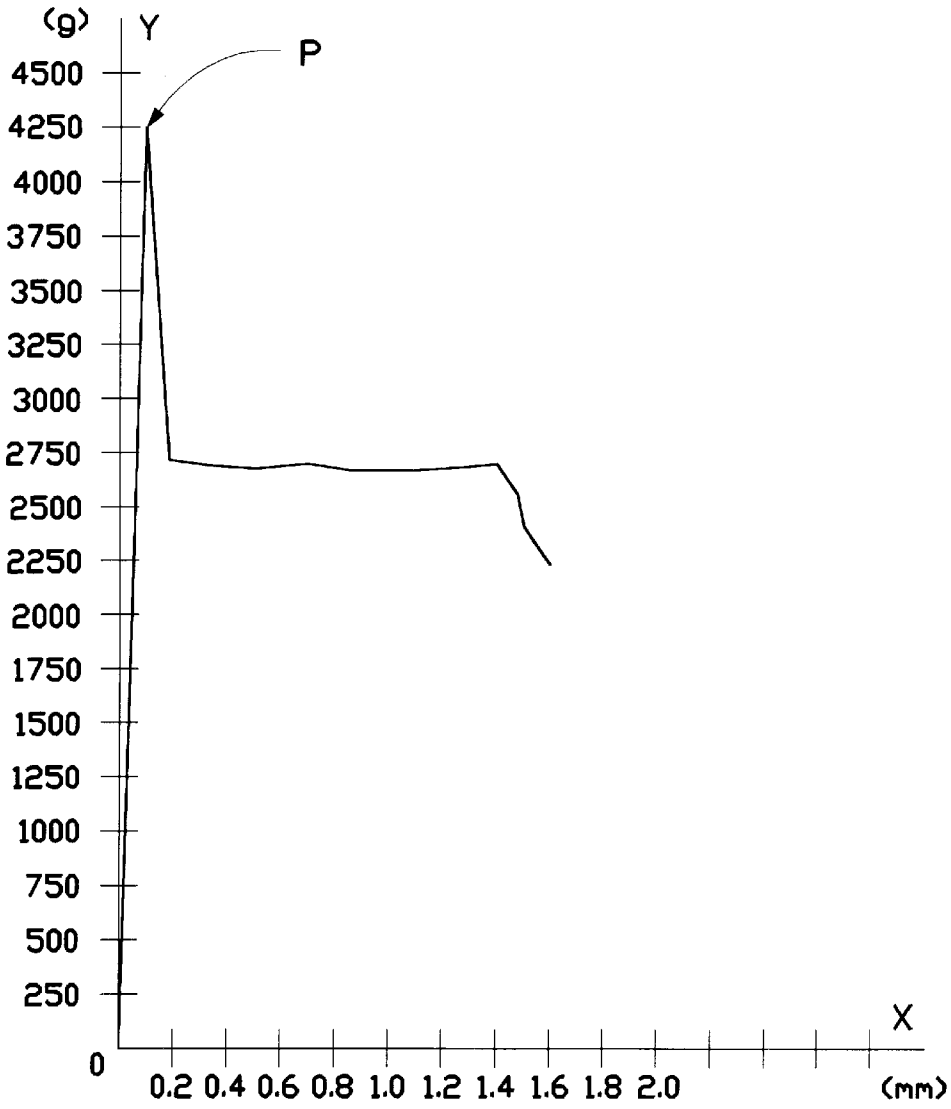
FIG.3 (PRIOR ART)
FIG. 3 is a diagram showing the relation between the insertion force and the distance that a fitting portion of the contact of FIG. 2 has been inserted into a dielectric housing of the electric connector.
Figure 6:
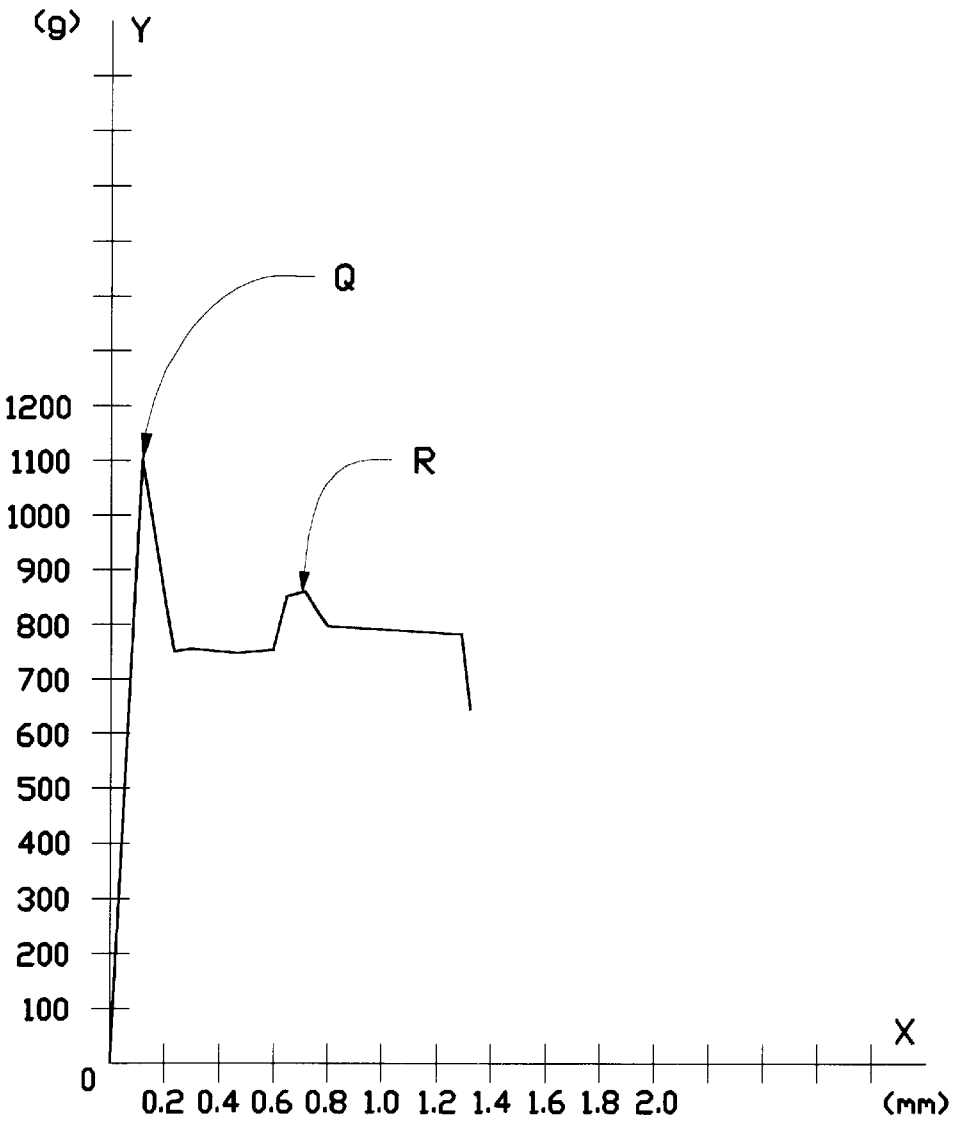
FIG. 6 is a diagram similar to FIG. 3 but shows the relation between the insertion force and the distance that a first fitting portion of the contact of FIG. 5 has been inserted into the dielectric housing of the electric connector.

Comparing FIG. 3 with FIG. 6, it can be seen that by the present invention, the maximum force for inserting the contact into the contact passage to fixedly mount the contact in the dielectric housing can be reduced from 4250 g to 1100 g, whereby the possibility that the housing defining the contact passage is ruptured by the contact when it is inserted into the housing can be greatly reduced.

Furthermore, since in the present invention the insertion force can be significantly reduced, the size of the pressing device for inserting the contact into the dielectric housing can be largely reduced. Thus, the area for accommodating and the cost for constructing the pressing device can be reduced accordingly.

Finally, by the present invention, if the contact 40 is initially misaligned when inserted into the corresponding contact passage 34, such misalignment can initially be corrected by the first fitting portion 44 when it is engaged with the base plate 33, and then corrected by the second fitting portion 46 when it is sequentially inserted into the base plate 33. Thus, the contact 40 in accordance with the present invention can achieve a better self-aligning effectiveness than the second prior art contact 20.

Although it is not shown by the drawings, it can be understood by those skilled in the art that the contact of the present invention can be constructed in another manner so that the positions of the first and second fitting portions 44 and 46 as shown in FIG. 5 are exchanged. If constructed this way, the contact 40 is mounted in the base plate 33 by first extending the terminal portion 42 through the corresponding contact passage 34 from the top face 332 of the base plate 33 until the contact 40 has reach its final predetermined mounting position.

While the present invention has been described with reference to specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

Therefore, persons of ordinary skill in this field shall understand that all such equivalent structures are to be included within the scope of the following claims.

We claim:

1. An electric connector comprising a housing and a plurality of contacts mounted in the housing by inserting the contacts into the housing to have an interference fit therewith, wherein:

the housing defines a mating connector receiving chamber and has a base plate having a top face defining a lower face of the mating connector receiving chamber, a bottom face, and a number of contact passages extending between the top and bottom faces; and the contacts each has:

a contact portion extending into the mating connector receiving chamber;

a body portion defining a first fitting portion protruding from two lateral sides of the body portion and a second fitting portion also protruding from the two lateral sides of the body portion, wherein the first fitting portion defines a first width having an interference fit with the base plate, and the second fitting portion defines a second width which is larger than the first width and also has an interference fit with the base plate; and a terminal portion extending below the bottom face of the base plate.

2. The electric connector as described in claim 1, wherein the second fitting portion is located nearer to the terminal portion than the first fitting portion.

3. The electric connector as described in claim 1, wherein the first fitting portion is located nearer to the terminal portion than the second fitting portion.

4. An arrangement of an electrical connector, said connector including a housing with a base plate defining a first surface and a second surface thereon, at least one contact being adapted to extend vertically through said base with at least two sets of fitting portions, along a lengthwise direction of said contact, of different dimensions, each of said fitting portions generating a substantial interference fit with the base plate during insertion of said contact into said housing; an insertion/installation direction of said contact with regard to the housing complying with a relationship of said lateral dimensions of said fitting portions wherein one of the fitting portions having a smaller lateral dimension engages the base plate before the other thereof having a larger lateral dimension, whereby all fitting portions are located between the first surface and the second surface when the contact reaches its final position in the housing.

* * * * *